US011577890B2

(12) United States Patent
Woody et al.

(10) Patent No.: US 11,577,890 B2
(45) Date of Patent: Feb. 14, 2023

(54) BEVERAGE CONTAINER

(71) Applicant: LWD-BB Inc., Cazadero, CA (US)

(72) Inventors: Nathan Woody, Philadelphia, PA (US); Dennis Wootten, Scotts Valley, CA (US); Paul Hammerstrom, Milford, NH (US); Josh Yablon, Oakland, CA (US)

(73) Assignee: LWD-BB INC., Cazadero, CA (US)

( * ) Notice: Subject to any disclaimer, the term of this patent is extended or adjusted under 35 U.S.C. 154(b) by 13 days.

(21) Appl. No.: 17/226,621

(22) Filed: Apr. 9, 2021

(65) Prior Publication Data

US 2021/0316913 A1 Oct. 14, 2021

Related U.S. Application Data

(60) Provisional application No. 63/007,615, filed on Apr. 9, 2020.

(51) Int. Cl.
*B65D 47/08* (2006.01)
*B65D 47/32* (2006.01)

(52) U.S. Cl.
CPC ..... *B65D 47/0871* (2013.01); *B65D 47/32* (2013.01)

(58) Field of Classification Search
CPC ..... B65D 47/0871; B65D 47/32; B65D 47/0857; B65D 51/18; B65D 43/02; B65D 43/26; B65D 43/265; B65D 43/267; B65D 43/22; B65D 47/24; B65D 47/26; B65D 47/20; B65D 43/24; A47G 19/2272
See application file for complete search history.

(56) References Cited

U.S. PATENT DOCUMENTS

| | | | | |
|---|---|---|---|---|
| 5,005,717 | A | 4/1991 | Oilar | |
| 5,153,977 | A | 10/1992 | Toida et al. | |
| 6,098,834 | A | 8/2000 | Hatsumoto et al. | |
| 7,073,678 | B1 | 7/2006 | Dibdin et al. | |
| 7,546,933 | B2 | 6/2009 | Pinelli | |
| D622,547 | S | 8/2010 | Carreno | |
| 7,997,442 | B2 | 8/2011 | Pinelli | |
| 8,348,078 | B2 | 1/2013 | Lane | |
| 8,590,731 | B2 | 11/2013 | Pinelli | |
| 8,602,238 | B2 | 12/2013 | El-Saden et al. | |
| 8,839,983 | B2 | 9/2014 | Chiou et al. | |
| 8,844,762 | B2 | 9/2014 | Chiou et al. | |
| 8,863,979 | B2 | 10/2014 | El-Saden et al. | |
| 8,967,414 | B2 | 3/2015 | Lane | |
| 9,095,233 | B2 | 8/2015 | Pinelli | |
| 9,162,802 | B2 | 10/2015 | El-Saden et al. | |
| 9,398,823 | B2 | 7/2016 | Pinelli | |
| 9,808,102 | B2 | 11/2017 | Pinelli | |
| 2019/0352058 | A1* | 11/2019 | Gauss | B65D 47/06 |

* cited by examiner

*Primary Examiner* — Donnell A Long
(74) *Attorney, Agent, or Firm* — McCarter & English, LLP

(57) ABSTRACT

An example beverage container lid is provided. The beverage container lid includes a lid body including a first opening formed therein. The beverage container lid includes a latch structure pivotably coupled relative to the lid body. The latch structure includes a first sealing element configured to align with the first opening and open or close the first opening in the lid body during pivoting of the latch structure relative to the lid body. The latch structure includes an engagement assembly configured to releasably engage with the lid body to allow for positioning of the latch structure in three or more operational mode positions.

17 Claims, 8 Drawing Sheets

BEVERAGE CONTAINER

CROSS-REFERENCE TO RELATED APPLICATIONS

This application claims the benefit of priority to U.S. Provisional Application No. 63/007,615, filed on Apr. 9, 2020, which is hereby incorporated by reference in its entirety.

TECHNICAL FIELD

The present disclosure relates to beverage containers. More specifically, the present disclosure relates to beverage containers including a lid capable of being positioned in a variety of operational modes.

BACKGROUND

A variety of insulated beverage containers (e.g., travel mugs) are available in the industry for those traveling via a vehicle or public transportation. However, such beverage containers may not fill the needs of cyclists or those traveling via a bicycle. Generally, the shape of traditional beverage containers is not compatible with the majority of bicycle bottle carriers (e.g., bottle cages), resulting in the beverage container either not fitting within the bottle cage or falling out of the bottle cage due to insufficient support. Such traditional beverage container designs may not account for ingress or egress of the beverage container from the bottle cage.

The design of traditional beverage containers may also not be sufficiently durable to handle drops, knocks, and/or other common occurrences on bicycle. Some traditional beverage containers necessitate a two-handed operation or extra attention from the user in order to operate, and therefore do not lend to one-handed operation. Some traditional beverage containers may have an elevated R-factor or that does not allow for venting to allow cooling of the contents of the beverage container, and/or may be designed in a way that increases the difficulty in cleaning all internal components susceptible to contact with the beverage.

SUMMARY

In accordance with embodiments of the present disclosure, an exemplary beverage container lid is provided. The beverage container lid includes a lid body including a first opening formed therein. The beverage container lid includes a latch structure pivotably coupled relative to the lid body. The latch structure includes a first sealing element configured to align with the first opening and open or close the first opening in the lid body during pivoting of the latch structure relative to the lid body. The latch structure includes an engagement assembly configured to releasably engage with the lid body to allow for positioning of the latch structure in three or more operational mode positions.

In some embodiments, the first opening in the lid body can be a drinking opening configured for passage of a beverage therethrough. The lid body can include a second opening formed therein, the second opening spaced from the first opening. The lid body can include a recessed top surface and a raised circumferential lip, the first opening formed in the recessed top surface.

The latch structure can include a closure section and an engagement section extending from the closure section at an angle (e.g., an acute angle). The closure section can include a T-shaped protrusion extending perpendicularly from a bottom surface of the closure section. The first sealing element can be releasably coupled to the T-shaped protrusion of the closure section. The latch structure can include a second sealing element configured to align with the second opening and open or close the second opening in the lid body during pivoting of the latch structure relative to the lid body.

The beverage container lid includes a selection structure slidably engaged with lateral extension guides of the lid body. The selection structure can include grooves on opposing side surfaces for slidable engagement with the lateral extension guides of the lid body. The selection structure can include at least one spring-loaded bearing biased laterally outward by a spring. The lid body can include grooves or detents formed therein, each of the grooves or detents corresponding with a respective one of the three or more operational mode positions of the latch structure.

In some embodiments, a first groove or detent of the lid body corresponds with a vent position of the latch structure resulting in a partially elevated position of the first sealing element relative to the first opening to permit venting and drinking from the first opening. In some embodiments, a second groove or detent of the lid body corresponds with a close position of the latch structure resulting in a normally sealed engagement of the first sealing relative to the first opening and permitting selective pivoting of the latch structure to elevate the first sealing element from the first opening. In some embodiments, a third groove or detent of the lid body corresponds with a lock position of the latch structure preventing pivoting of the latch structure and maintaining the first opening closed by the first sealing element. In some embodiments, a fourth groove or detent of the lid body can correspond with a clean position of the latch structure, the clean position permitting pivoting of the latch structure by at least 90° relative to a top surface of the lid body.

The beverage container lid can include a button assembly including a button and a spring. The spring can impart a bias force against the selection structure at one end and can impart a bias force with the button against the latch structure at an opposing end. The closure structure can include an opening formed therein, the opening providing a nose void for clearance of a user's nose during drinking from the beverage container.

In accordance with embodiments of the present disclosure, an exemplary beverage container is provided. The beverage container includes a vessel configured to receive a beverage, and a lid assembly detachably coupled to the vessel. The lid assembly includes a lid body including a first opening formed therein. The lid assembly includes a latch structure pivotably coupled relative to the lid body. The latch structure includes a first sealing element configured to align with the first opening and open or close the first opening in the lid body during pivoting of the latch structure relative to the lid body. The latch structure includes an engagement assembly configured to releasably engage with the lid body to allow for positioning of the latch structure in three or more operational mode positions.

In accordance with embodiments of the present disclosure, an exemplary method of operating a beverage container lid is provided. The method includes pivoting a latch structure relative to a lid body. The lid body includes a first opening formed therein, and the latch structure includes a first sealing element configured to align with the first opening and open or close the first opening in the lid body during pivoting of the latch structure relative to the lid body, and an engagement assembly. The method includes releasably engaging the engagement assembly with the lid body to position and retain the latch structure in three or more operational mode positions.

BRIEF DESCRIPTION OF THE DRAWINGS

To assist those of skill in the art in making and using the disclosed beverage container, reference is made to the accompanying figures, wherein.

DETAILED DESCRIPTION

Figure 1:
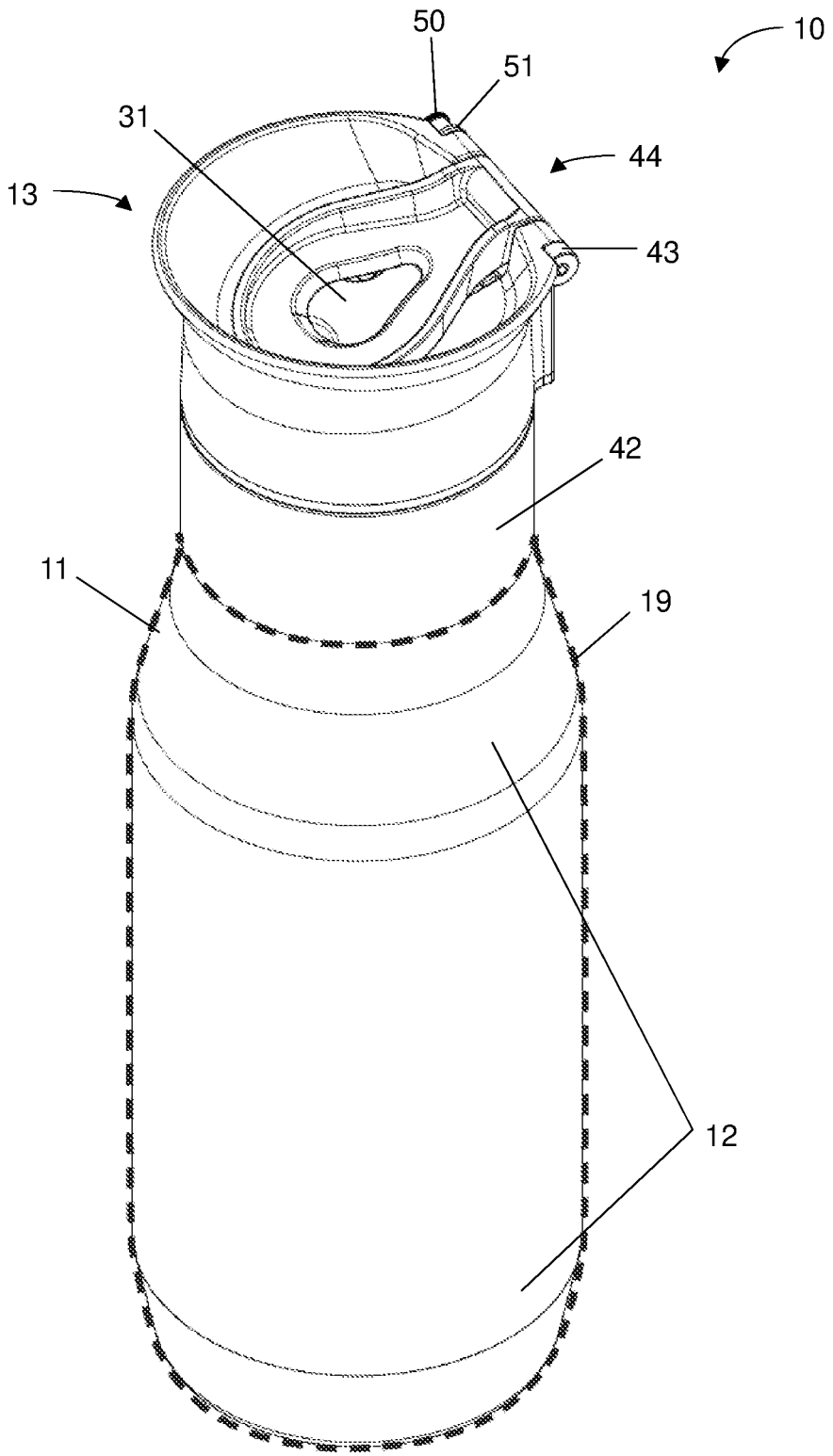
FIG. 1 is a perspective view of an exemplary beverage container of the present disclosure.

FIGS. 1-10 show perspective, cross-sectional and detailed views of an exemplary beverage container 10 (e.g., mug, insulated mug, or the like) of the present disclosure in a variety of operational modes. The beverage container 10 includes a bottom section (e.g., a fluid-receiving section) in the form of a vessel 11 sized and shaped for use with bicycle-mounted drink carriers. For example, the vessel 11 can include contours 12 (e.g., a substantially cylindrical central region, a tapered top region, a tapered bottom region, or the like) that assist in placing the beverage container 10 into the drink carrier, maintaining the position of the beverage container 10 in the drink carrier, and removing the beverage container 10 from the drink carrier.

The beverage container 10 includes a lid 13 detachable from the top section of the vessel 11 such that a beverage can be poured into the interior of the vessel 11. The lid 13 includes a latch structure 44 actionable with one or two hands in a variety of modes for operation of the beverage container 10. The latch structure 44 is configured for ease of use such that an individual can use a single hand to operate the latch structure 44 between the different modes of operation. The lid 13 generally defines a cylindrical bottom section 60 extending upwardly from the bottom edge of the lid 13, and an outwardly tapered or fluted top section 61 extending from the cylindrical bottom section 60 up to a top edge or surface of the lid 13. The fluted top section 61 of the lid 13 provides a gripping surface for the individual and facilitates single-handed retrieval of the container 10 from a carrier. Once in hand, a selection assembly 14 on the lid 13 allows the user to selectively choose from four detent modes for different operations of the lid 13. Particularly, the selection assembly 14 allows the lid 13 to be operated in a vented position, a closed position (e.g., a push to open position), a locked position, and a cleaning position.

Figure 2:
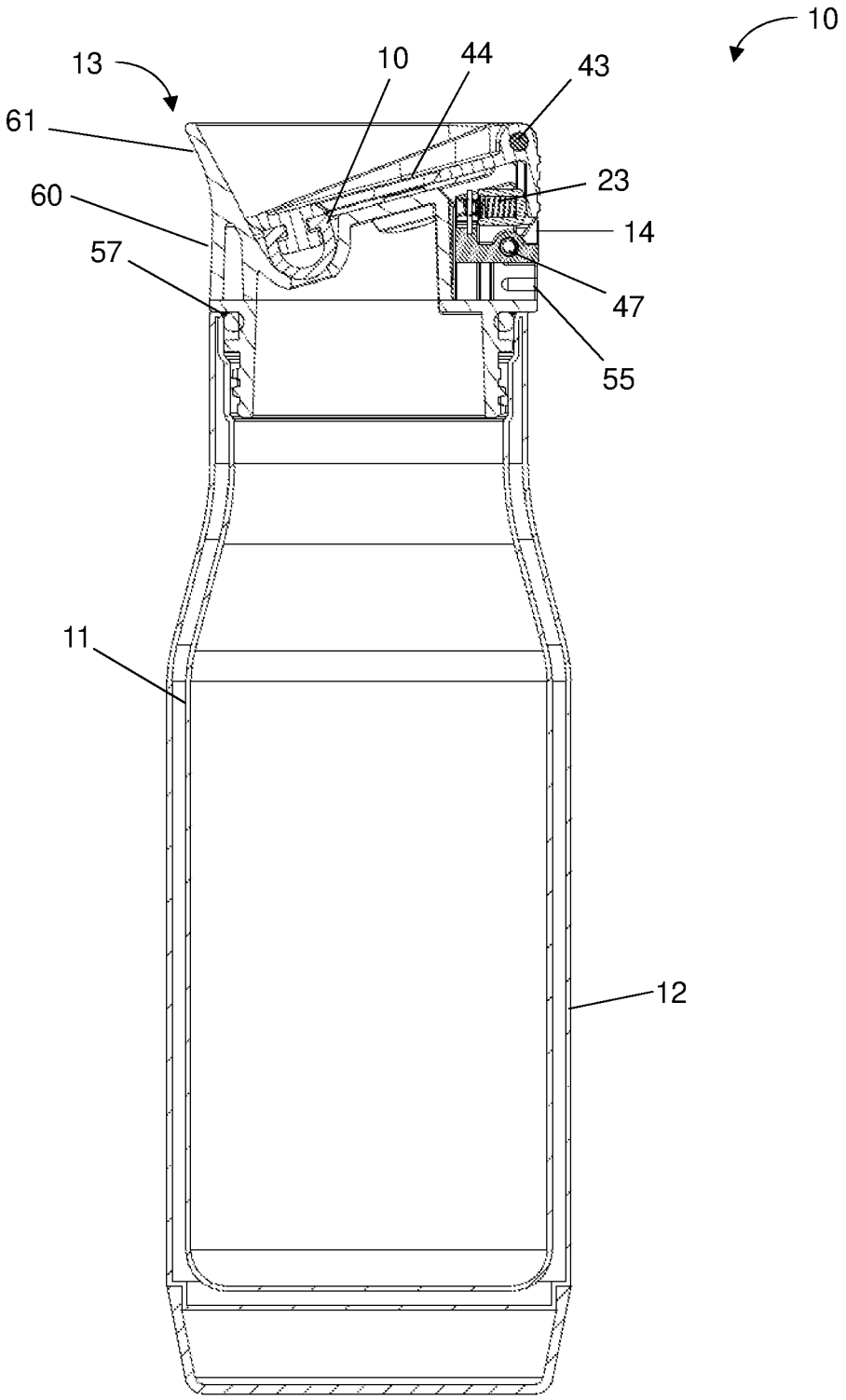
FIG. 2 is a cross-sectional view of an exemplary beverage container of FIG. 1.

The latch structure 44 includes a substantially planar closure section 64 and an engagement section 65 extending from the closure section 64. The closure section 64 can define a substantially planar element with a raised circumferential lip at least partially extending around the perimeter of the top surface. The engagement section 65 can extend from the closure section 64 at an acute angle. The connection of the engagement section 65 to the closure section 64 acts as the pivot point and/or axis of the latch structure 44. The lid body 63 includes a recessed top surface 66 with two spaced holes or bezels 41, 40. In use, the bezel 41 allows for drinking of the beverage in the container 10 by passage of the beverage through the hollow interior 67 of the lid body 63 and through the bezel 41. A raised circumferential lip 68 surrounds the recessed top surface 66, providing a convenient area for drinking the beverage passing through the bezel 41. As shown in FIG. 2, the top surface of the lid body 63 can be angled downwardly from a rear end to a front end of the lid body 63 such that the circumferential lip 68 is dimensioned greater at the front of the lid body 63 as compared to the rear of the lid body 63. The bezel 40 allows for venting of air in and/or out of the container 10 for improved drinking.

The bottom surface of the closure section 64 (e.g., the surface facing the top surface 66 of the lid body 63) includes two attachment protrusions 69, 70 extending substantially perpendicularly therefrom. The protrusions 69, 70 can define substantially T-shaped configurations, and are configured and dimensioned to releasably receive closure domes 71, 72 (e.g., flexible sealing elements). For example, the domes 71, 72 can be fabricated from a rubber and/or silicone material, providing flexibility to the domes 71, 72. Each dome 71, 72 can define a substantially cylindrical body with a hole 73, 74 at the top surface extending into a hollow interior. During assembly, the T-shaped protrusions 69, 70 can be passed through the respective openings 73, 74, and the domes 71, 72 can be flexed over the protrusions 69, 70 to secure the domes 71, 72 at least partially over the protrusions 69, 70.

The lid body 63 includes a cup-shaped extension 75, 76 associated with each respective bezel 41, 40. The cup-shaped extensions 75, 76 can be dimensioned complementary to the outer surface of the respective domes 71, 72 to allow for selective opening and closing of the bezels 41, 40 as the latch structure 44 pivots about pivot point or void 59 (e.g., a pivot pin or bar). Although the dome 71 is dimensioned greater than the dome 72, in some embodiments, both domes 71, 72 can be dimensioned substantially equally. The domes 71, 72 substantially align with and at least partially receive the respective extensions 75, 76, with the domes 71, 72 capable of sealing the bezels 41, 40. The outer surface of the bottom half or section of the lid body 63 includes threads 77 complementary to inner threads of the vessel 11, allowing for threaded engagement between the vessel 11 and the lid body 63.

Figure 3:
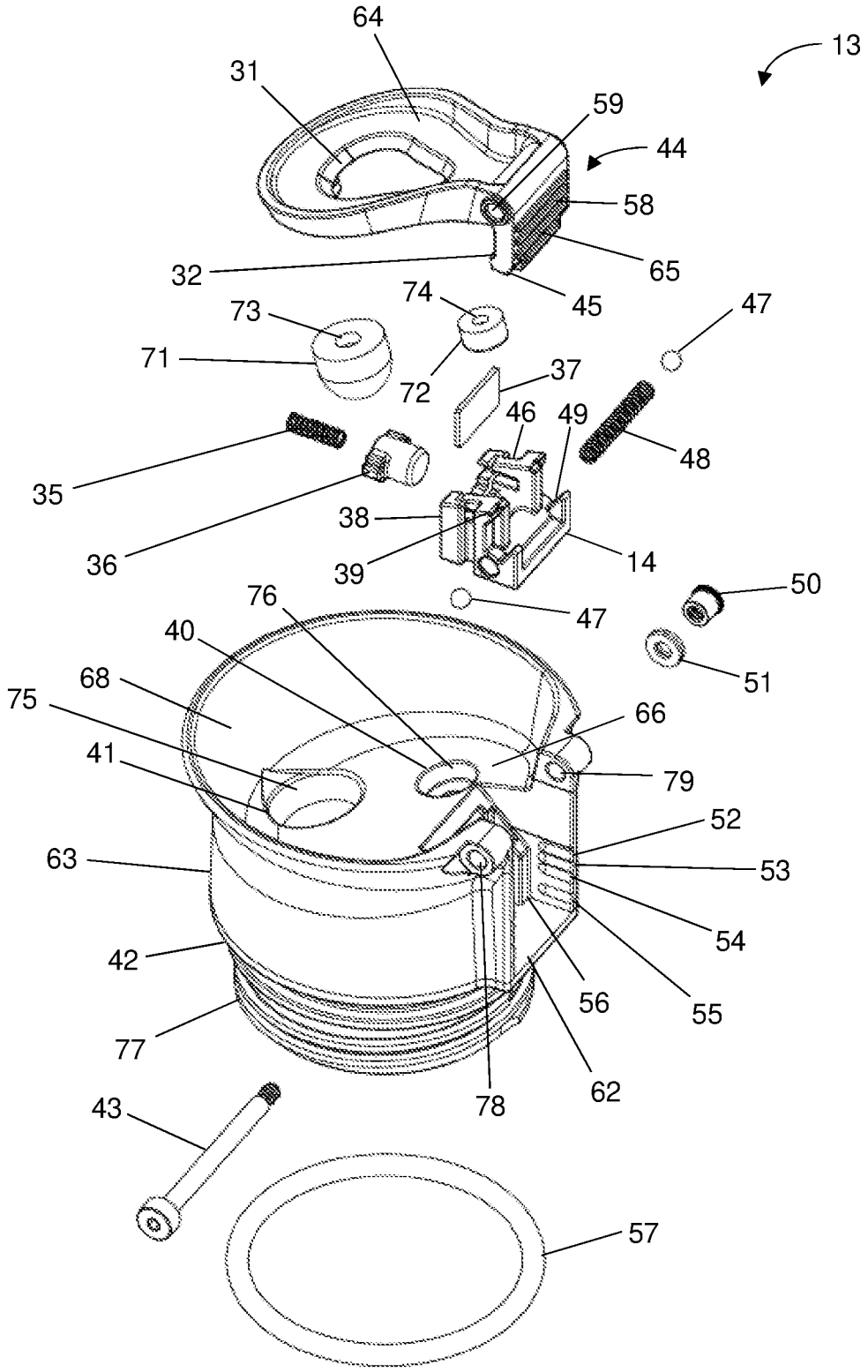
FIG. 3 is an exploded view of a lid of an exemplary beverage container of FIG. 1.

The lid 13 includes a selection assembly 14 on a lateral side of the lid 13 that allows the user to selectively choose from the four detent modes for different operations of the container 10. As illustrated in FIG. 3, the topmost position of the selection assembly 14 can correspond with a vent detent 52. In the vent mode, the domes 71, 72 are slightly elevated from the bezels 41, 40 to allow for cooling or venting of the beverage through the bezels 41, 40 and allowing the user to drink from the container 10 without manipulating the latch structure 44 (e.g., the selection assembly 14 maintains the domes 71, 72 separated from the bezels 41, 40). The second from the top position of the selection assembly 14 can correspond with a close detent 53 (e.g., an unlocked, press to open position). In the closed position, the force imparted by the spring-loaded button 36 on the engagement section 65 biases the domes 71, 72 into a normally closed position while allowing the user to press against the engagement section 65 against the biasing force to pivot the latch structure 44 and move the domes 71, 72 away from the bezels 41, 40. The third from the top position of the selection assembly 14 can correspond with a locked detent 54. In the locked position, the selection assembly 14 prevents the latch structure 44 from being pivoted, preventing movement of the domes 71, 72 from the bezels 41, 40. The fourth from the top position (e.g., bottommost) of the selection assembly 14 can correspond with a clean detent 55. In the clean position, the latch structure 44 can be pivoted by 90° or more to allow for cleaning of the bezels 41, 40 and the domes 71, 72. The detents 52-55 can be substantially vertically oriented relative to each other, and can be formed on opposing lateral sides of a substantially U-shaped cutout 62 in the lid body 63. The cutout 62 can be shaped to provide clearance for pivoting of the engagement section 65 of the latch structure 44 during pivoting of the latch structure 44 into the cleaning operational mode.

Figure 4:
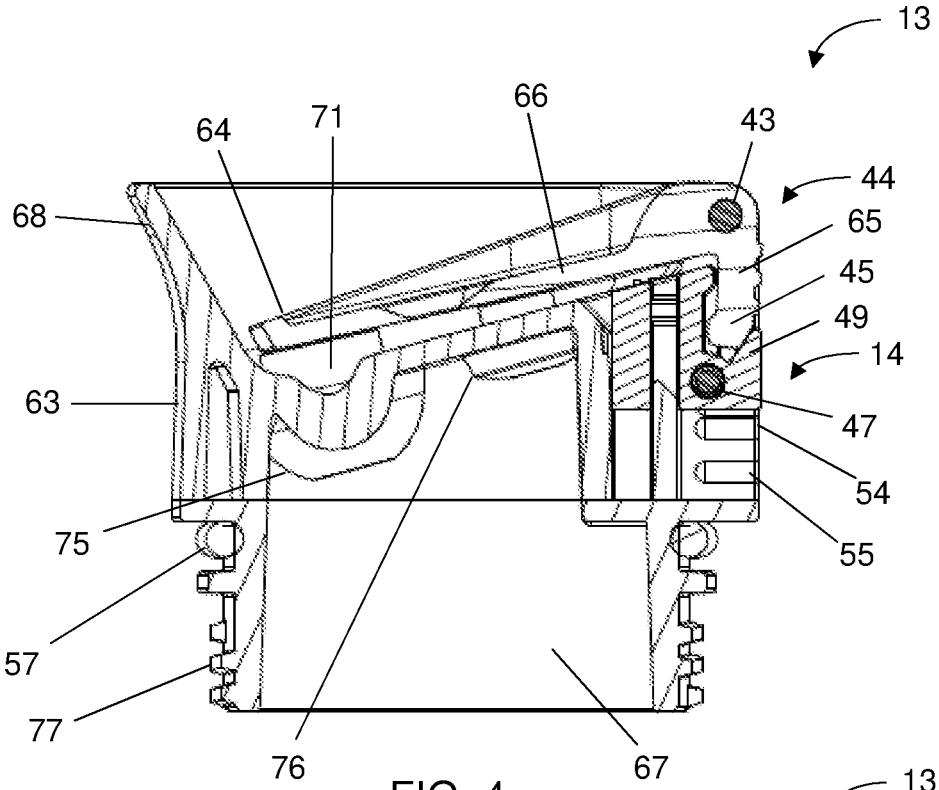
FIG. 4 is a cross-sectional view of a lid of an exemplary beverage container of FIG. 1 in a vent operational mode.
Figure 5:
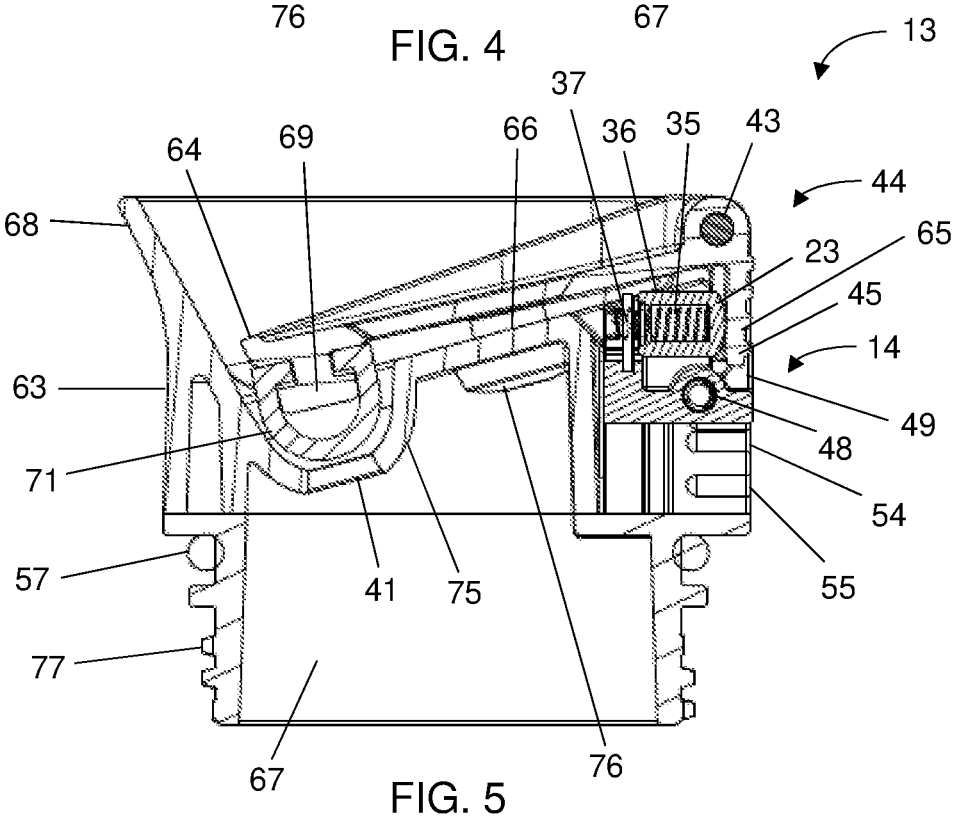
FIG. 5 is a cross-sectional view of a lid of an exemplary beverage container of FIG. 1 in a vent operational mode.

As an example, FIG. 4 is a cross-sectional view of the lid 13 in a vent operational mode. The vented position allows for the lid 13 to remain in an open position to allow the contained beverage to both cool/vent and be accessible to the user without further manipulation of the lid 13 and/or latch mechanism (e.g., selection assembly 14). FIG. 4 shows the interaction between faces 45, 49 that provides the resultant venting functionality. In particular, the engagement section 65 can be pushed vertically upward to pivot the latch structure 44 until the vent detent 52 is engaged by the spring-loaded bearings 47 to maintain the latch structure 44 in the vent operational mode position. In the vented position, when the latch structure 44 is engaged with the topmost detent 52, the face 49 exerts a force against face 45, forcing the domes 71, 72 out of their respective cavities or bezels 41, 40. Such engagement maintains the bezels 41, 40 open for venting of the beverage and for drinking of the beverage through the bezels 41, 40 without further manipulation of the latch structure 44 by the user. The friction and/or force of the ball bearings 47 in the detent 52 grooves maintains the assembly in place. FIG. 5 provides another cross-sectional view of the lid 13 in a vented position. In particular, FIG. 5 illustrates the separation between the dome 71 and the bezel 41 to allow for flow of the beverage and/or air through the bezel 41, i.e., through the lid 13. In some embodiments, in the vent mode, the dome 72 can be separated from the bezel 40.

Figure 6:
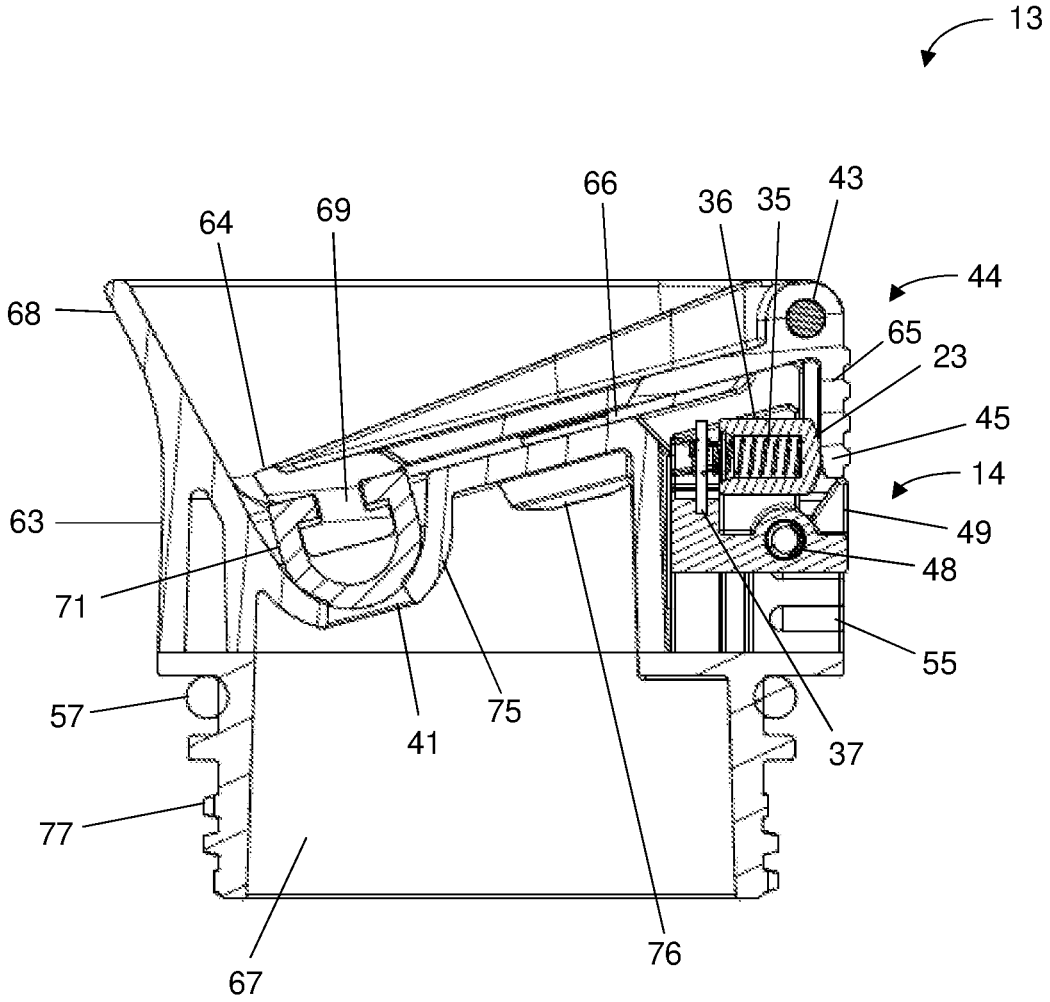
FIG. 6 is a cross-sectional view of a lid of an exemplary beverage container of FIG. 1 in an unlocked, closed operational mode.

As a further example, FIG. 6 is a cross-sectional view of the lid 13 in an unlocked, closed operational mode position. The closed position allows for the lid 13 to remain in a closed position without any user interaction (e.g., the domes 71, 72 are positioned against the bezels 40, 41 to prevent undesired passage of the beverage through the bezels 40, 41. The engagement structure 65 can be moved vertically to pivot the latch structure 44 until the close detent 53 is engaged by the spring-loaded bearings 47 to maintain the latch structure 44 in the closed operational mode position. Upon user depression of surface of latch texture 58 (e.g., engagement section 65), the latch structure 44 can be pivoted to lift the domes 71, 72 from the respective bezels 40, 41, and the drink and vent closure can open and allows the beverage to flow out by pivoting the latch structure 44 about the pin 43. Thus, in the unlocked, closed mode the user can interact with the latch structure 44 when drinking of the beverage is desired. In some embodiments, the selection structure 14 can be used to lock the latch structure 44 in a pivoted position to maintain the bezels 40, 41 open and spaced from the domes 71, 72.

Figure 7:
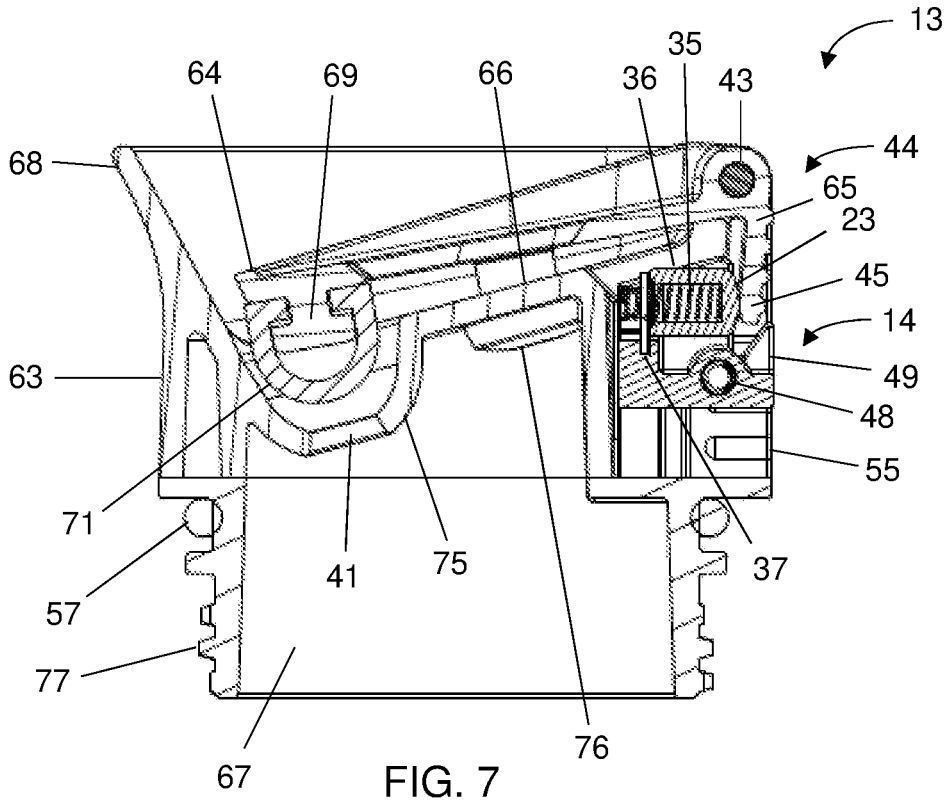
FIG. 7 is a cross-sectional view of a lid of an exemplary beverage container of FIG. 1 in an unlocked, open operational mode.
Figure 8:
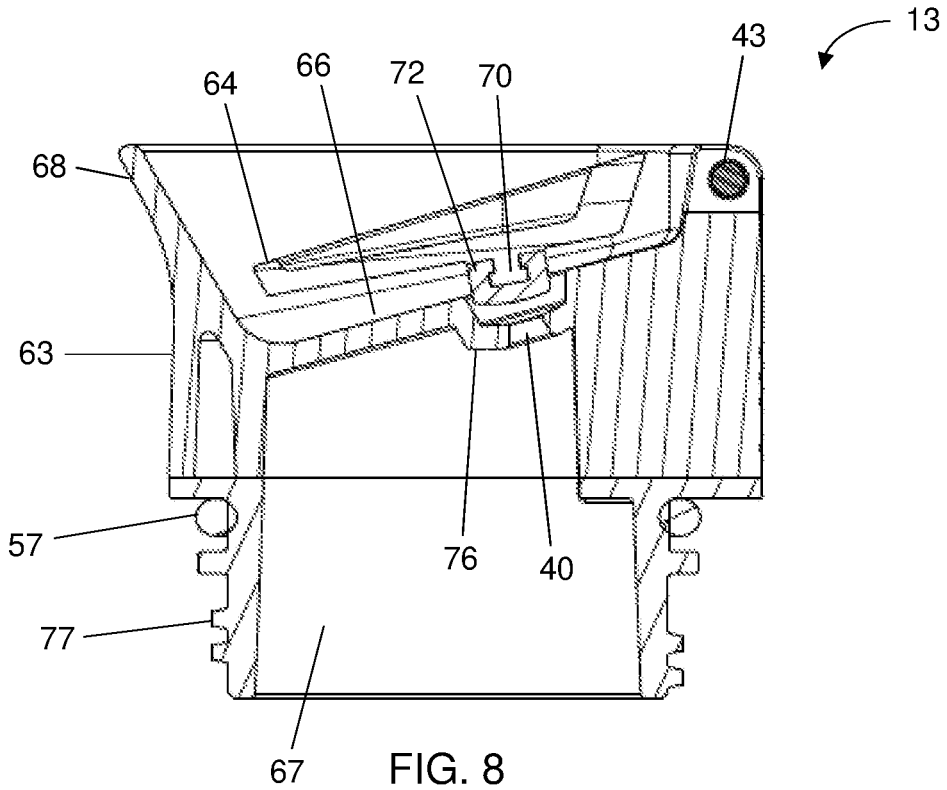
FIG. 8 is a cross-sectional view of a lid of an exemplary beverage container of FIG. 1 in an unlocked, open operational mode.

As a further example, FIGS. 7-8 are cross-sectional views of the lid 13 in an unlocked, open operational mode position. The engagement structure 65 can be moved vertically to pivot the latch structure 44 until the open detent 54 is engaged by the spring-loaded bearings 47 to maintain the latch structure 44 in the open operational mode position. In such position, the domes 71, 72 are pivoted and elevated away from the bezels 41, 40 by a greater vertical distance than in the vent operational mode position, providing for increasing flow of the beverage out of the container 10. FIG. 7 illustrates the offset position of the dome 71 relative to bezel 41, and FIG. 8 illustrates the offset position of the dome 72 relative to bezel 40. Thus, the unlocked operational mode allows the latch structure 44 to be selectively pivoted when the user chooses to drink the beverage, preventing undesired pouring of the beverage from the container 10.

Figure 9:
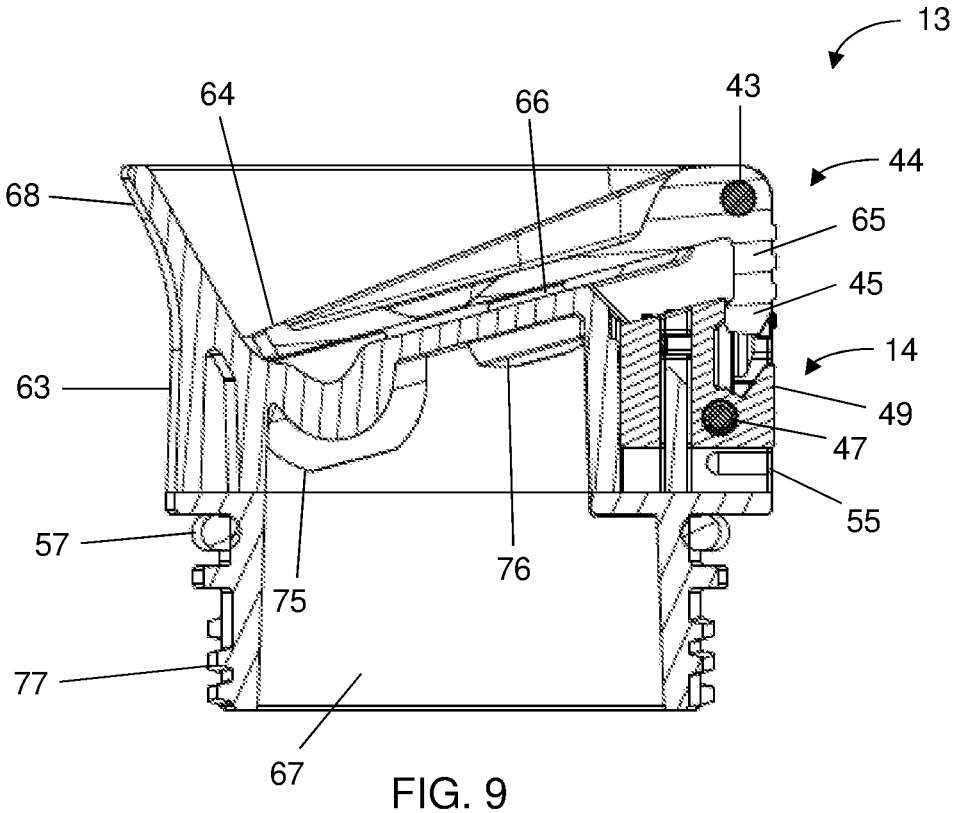
FIG. 9 is a cross-sectional view of a lid of an exemplary beverage container of FIG. 1 in a lock operational mode.
Figure 10:
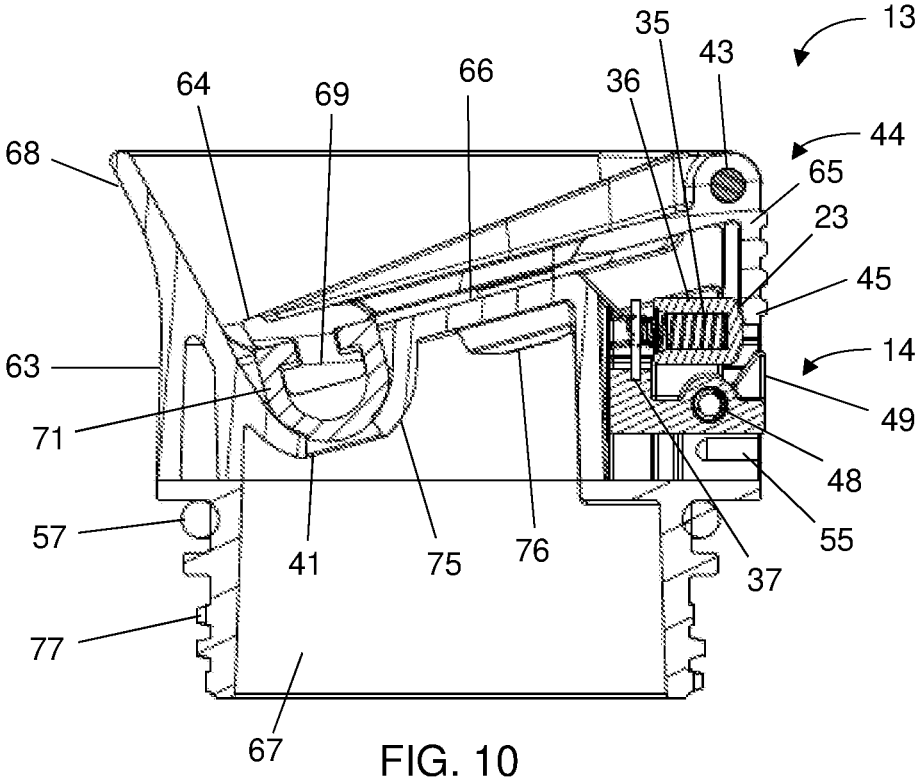
FIG. 10 is a cross-sectional view of a lid of an exemplary beverage container of FIG. 1 in a lock operational mode.

As a further example, FIGS. 9-10 are cross-sectional views of the lid 13 in a locked operational mode position. The lock position allows for the lid 13 to remain in a locked position and resists opening when a user manipulates the latch structure 44. FIGS. 9-10 show the interaction between faces 32, 39. The engagement structure 65 can be moved vertically to pivot the latch structure 44 until the locked detent 53 is engaged by the spring-loaded bearings 47 to maintain the latch structure 4 in the locked, closed operational mode position. In the locked operational mode position, the locked detent 53 holds the engagement structure protrusion face 39 against the latch structure protrusion face 32, removing the space in which the latch structure 44 would normally pivot, effectively keeping the latch structure 44 closed and in the locked position. FIG. 10 illustrates the interaction or engagement of the dome 71 and bezel 41 to disallow or prevent the flow of the beverage through the bezel 41 in the lid 13. A similar engagement or interaction occurs with the dome 72 and the bezel 40. Thus, in the locked operational mode, pressing on the latch structure 44 has no effect on pivoting the latch structure 44 and the bezels 40, 41 remain closed to prevent undesired opening of the bezels 40, 41.

Figure 11:
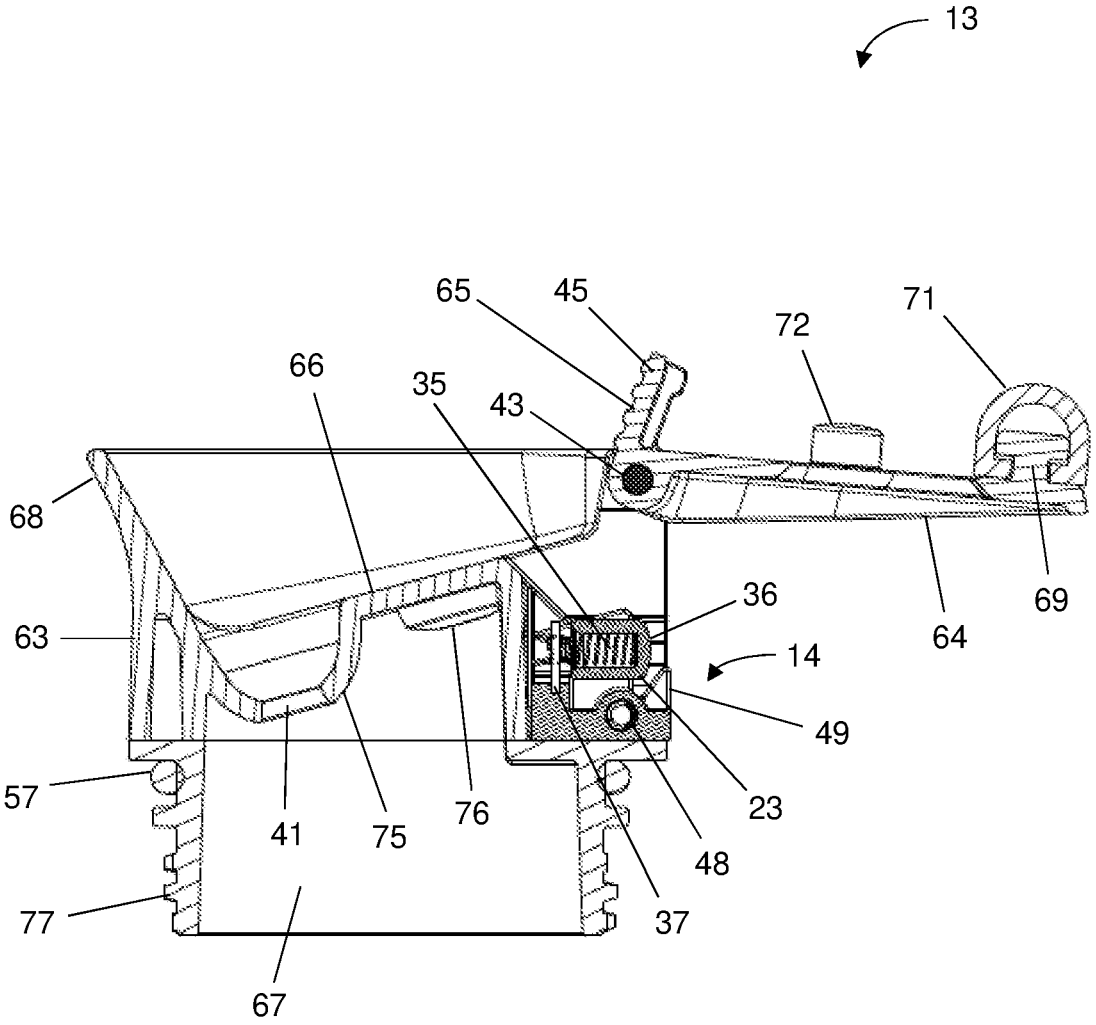
FIG. 11 is a cross-sectional view of a lid of an exemplary beverage container of FIG. 1 in an unlocked, clean operational mode.

As a further example, FIG. 11 is a cross-sectional view of the lid 13 in an unlocked, clean operational mode position. The clean position allows for the latch structure 44 (and the domes 71, 72) to be pivoted away from the holes or bezels 40, 41 for cleaning of the area around the bezels 40, 41 and the inner surface of the lid 13. In particular, the latch structure 44 can be entirely pivoted away from the bezels 40, 41, providing access to the bezels 40, 41 and domes 71, 72 for cleaning.

Each of the modes can be selected by sliding a feature (e.g., tongues 56) of the selection assembly 14 vertically on the selection channels 46, and engaging the desired selection bearings 47 into the detents 52-55. The selection assembly 14 is created to interact with latch structure 44 and lid structure 42 via the user selecting detents 52-55. Selection structure 38 houses selection bearings 47, selection spring 48, and button assembly 36. Selection structure 38 is tooled with channels 46 that allow for vertical travel along lid structure 42 via selection tongues 56 (e.g., vertical guides or protrusions). The selection structure 38 can thereby slide substantially vertically along the selection tongues 56, with such movement transferring to pivoting of the latch structure 44.

The latch structure 44 can provide for a range of motion defined by interaction between faces 45, 49 on selection structure 38, as well as interaction between lock face 32 and lock notch 39. For example, the face 49, when the latch structure 44 is placed in the topmost detent 52, can exert a force against face 45, pivoting the domes 69, 70 out of their respective cavities. Friction and/or force provided by the bearings 47 can keep the assembly in place relative to the detent 52. The face 32 can interact with the protrusion on the latch structure 64 that interacts with the notch 39 on the engagement structure 65, where such contact between the two eliminates the ability of the latch structure 44 to pivot, thereby locking the lid assembly in the closed position. The latch structure 44 can include an opening 31 formed therein. The opening 31 can act as a nose void that limits interference with the user's nose while drinking. For example, the user's nose can at least partially pass through the opening 31 while drinking from the container 10. The latch structure 44 can pivot around a pivot bolt 43 inserted within pivot void 59. The pivot bolt 43 can extend through the void 59 and into pivot openings 78, 79 on opposing sides of the U-shaped cutout 62 in the lid body 63.

The mode detents 52-55 (e.g., grooves) can interact with a selection spring 48 that presses or biases outward on selection bearings 47 to secure the selection structure 38 within the respective four vertically separated detents 52-55. As the latch structure 44 is slid upward or downward, the bearings 47 can be pushed inwardly to allow for pivoting of the latch structure 44, and the spring 48 can bias the bearings 47 outward to snap into respective detents 52-55, allowing the user to select which detent 52-55 the bearings 47 should remain in depending on the desired operational mode of the container 10. The top surface of the lid 13 includes holes or bezels 40, 41 that correspond with the protrusions 69, 70 on the bottom of the latch structure 44. Moving or pivoting the latch structure 44 relative to the top of the lid 13 in each of the operation modes positions the domes 71, 72 relative to the bezels 40, 41 in a way that allows for venting, closing or cleaning of the lid 13.

For vent operation, the top or first detent 52 can be selected by vertically sliding the engagement structure 65 until the bearings 47 engage with the detent 52. The selection vent face 49 interacts with latch vent face 45 to keep the lid 13 open via wedging of the two faces. Such wedging or engagement of the latch structure 44 slightly up above the surface of the recessed top surface 66 allows heat (or cold) to escape from the vessel 11 as well as relieving any pressure that could build inside of the vessel 11. This wedging lifts the domes 71, 72 from their respective bezels 40, 41, to allow access to the beverage inside of the vessel 11 (e.g., allows drinking of the beverage).

For closed operation, the second detent 53 from the top can be selected by vertically sliding the engagement structure 65 until the bearings 47 engage with the detent 53. Button spring 35 places force between button structure 36 and button stopper 37 (positioned within a slot formed in the selection structure 38), forming the button assembly 23. The button assembly 23 places force on latch structure 44 to ensure a firm seating of the domes 71, 72 within the respective bezels 40, 41. The latch structure 44 remains closed until user interaction or pressure on latch texture 58 (e.g., engagement section 65) overcomes the button assembly 23 tension or bias force created by the spring 35, to pivot and remove the sealing domes 71, 72 from their respective bezels 40, 41. Thus, in the closed operational mode, the bezels 40, 41 remain closed until the user pivots the latch structure 44 to pivot the domes 71, 72 for drinking of the beverage.

For locked operation, the third detent 54 from the top can be selected by vertically sliding the engagement structure 65 until the bearings 47 engage with the detent 54. Lock face 32 of latch structure 44 abuts against lock notch 39 on selection structure 38 to prevent movement of latch structure 44. For clean operation, the bottommost detect 55 can be selected by vertically sliding the engagement structure 65 until the bearings 47 engage with the detent 55. The entire selection assembly 14 slides below the rotation arc of the latch structure 44 to allow access to the dome 71 and bezel 41, and the dome 72 and bezel 40.

The beverage container 10 includes additional structural elements that allow for improved operation of the beverage container 10 as compared to traditional beverage containers. The nose void 31 can be in the form of an opening within latch structure 44 to limit the user's nose interference. The lock face 32 can be a portion of latch structure 44 designed to interact with selection structure 38 to eliminate any movement of latch structure 44. The dome 72 (e.g., a vent sealing member) can be used to seal within vent bezel 40, and allows for pressure equalization while the user drinks. The dome 71 (e.g., a drink sealing member) can be used to seal within drink bezel 41, and is placed where the user would access liquid (e.g., drink) from within the beverage container 10 under normal use. In some embodiments, the domes 71, 72 can be replaced with flexible O-rings on the protrusions 69, 70, with the respective bezels 40, 41 adjusted in size to correspond with the O-rings.

The button spring 35 can be used between button structure 36 and button stopper 37 to provide appropriate force on the button to keep latch structure 44 closed until interacted with by the user. The button structure 36, while in use in closed detent 53, exerts force from button spring 35 onto latch structure 44 to ensure the domes 71, 72 stay seated in the drink bezel 41 and vent bezel 40. The button stopper 37 sets a limit for button spring 35 to exert force on button structure 36. The selection structure 38 can be in the form of a chassis including channels, grooves, faces and angles to allow for functionality of latch modes. The selection structure 38, in combination with other components of the lid 13, creates the selection assembly 14. In some embodiments, the selection structure 38 (including components 35, 36, 37, 38) can be encased within a housing. In some embodiments, the selection structure 38, channels, latch texture, and/or detents can be elongated vertically to increase stability and refine user experience in using the detents.

The lock notch 39 can be a specific, complementary shape on selection structure 38 to interact with lock face 32 on latch structure 44. The lock notch 39 can serve to resist latch structure 44 from pivoting around pivot bolt 43, thus keeping domes 71, 72 inside vent bezel 40 and drink bezel 41. The vent bezel 40 is positioned beneath dome 72 on latch structure 44, and can be a shaped void in lid structure 42 to allow for pressure equalization in vessel 11. The drink bezel 41 can be positioned beneath dome 71 on latch structure 44, and can be a shaped void in lid structure 42 to allow for the user to drink liquids from inside beverage container 10.

The lid structure 42 can be a chassis including of voids, channels, tooling, detents, faces to allow for functionality of modes and user interaction. The pivot bolt 43 can form a pivot point which allows latch structure 44 to move in such a way as to allow for functionality of the modes described herein. The latch structure 44 can be in the form of a chassis including faces, voids, mounts, tooling to allow for functionality of modes and user interaction. The latch vent face 45 can be a portion of latch structure 44 designed to wedge with selection structure 38 to remove domes 71, 72 from their respective bezels.

The selection channels 46 can be specific tooling designed as part of selection structure 38 to allow vertical travel of the selection structure 38 along tongues 56 for change of the detent 52-55 modes. The selection bearings 47 exert the outwardly biasing force of selection spring 48 against the walls of the lid structure 42 mode detents 52-55, serving to secure selection assembly 14 into one of four defined modes corresponding with the respective detents 52-55. The selection spring 48 provides force to secure selection bearings 47 into four detent modes 52-55 on lid structure 42. In some embodiments, the selection bearing 47 and selection spring 48 can be in the form of bulbs molded to the selection structure 38. The selection vent face 49 is a portion of selection structure 38 designed to wedge with latch structure 44 at latch vent face 45 to remove domes 71, 72 from their respective bezels 41, 40.

The pivot nut 50 secures pivot bolt 43 in place. The pivot washer 51 allows for fixing of pivot bolt 43 while maintaining ability of latch structure 44 to rotate around pivot bolt 43. The vent detent 52 can be a detent on lid structure 42 that secures selection structure 38 in place, maintaining the wedge between latch vent face 45 and selection vent face 49. The close detent 53 can be a detent on lid structure 42 that secures selection structure 38 in place allowing for button structure 36 to exert outward force on latch structure 44 that is overcome by user interaction. The lock detent 54 can be a detent on lid structure 42 that secures selection structure 38 in place maintaining friction between lock face 32 on latch structure 44 with lock notch 39 on selection structure 38. The clean detent 55 can be a detent on lid structure 42 that allows selection structure 38 to move to position that it will not interact with latch structure 44 allowing latch structure 44 to rotate further out around pivot bolt 43.

The selection tongue(s) 56 can interact with selection channel(s) 46 on selection structure 38 to allow for vertical travel of selection structure 38 within lid structure 42 and along mode detents 52-55. The lid O-ring 57 attaches to lid structure 42 to provide a waterproof seal on interaction with lid structure 42 and vessel 11. The latch texture 58 can be alternately raised and lowered tooling to provide sensory feedback and increased control over user interaction with latch structure 44. The pivot void 59 can be a void on latch structure 44 to allow pivot bolt 43 to pass through and allow for pivot action of latch structure 44.

In some embodiments, a removable silicone sleeve 19 (see FIG. 1) can be positioned over the vessel 11 to protect the vessel 11 from potential damage during, e.g., insertion into the drink carrier, dropping of the beverage container 10, combinations thereof, or the like. In some embodiments, the sleeve 19 can assist in handling of the beverage container 10.

While exemplary embodiments have been described herein, it is expressly noted that these embodiments should not be construed as limiting, but rather that additions and modifications to what is expressly described herein also are included within the scope of the present disclosure. Moreover, it is to be understood that the features of the various embodiments described herein are not mutually exclusive and can exist in various combinations and permutations, even if such combinations or permutations are not made express herein, without departing from the spirit and scope of the present disclosure.

The invention claimed is:

1. A beverage container lid, comprising:

a lid body including a first opening formed therein; and a latch structure pivotably coupled relative to the lid body, the latch structure including (i) a first sealing element configured to align with the first opening and open or close the first opening in the lid body during pivoting of the latch structure relative to the lid body, and (ii) an engagement assembly configured to releasably engage with the lid body to allow for positioning of the latch structure in three or more operational mode positions; and a selection structure slidably engaged with lateral extension guides of the lid body;

wherein:

the selection structure includes at least one spring-loaded bearing biased laterally outward by a spring; and the lid body includes grooves or detents formed therein, each of the grooves or detents corresponding with a respective one of the three or more operational mode positions of the latch structure.

2. The beverage container lid of claim 1, wherein the first opening in the lid body is a drinking opening configured for passage of a beverage therethrough.

3. The beverage container lid of claim 1, wherein the lid body includes a second opening formed therein, the second opening spaced from the first opening.

4. The beverage container lid of claim 3, wherein the latch structure includes a second sealing element configured to align with the second opening and open or close the second opening in the lid body during pivoting of the latch structure relative to the lid body.

5. The beverage container lid of claim 1, wherein the lid body includes a recessed top surface and a raised circumferential lip, the first opening formed in the recessed top surface.

6. The beverage container lid of claim 1, wherein the latch structure includes a closure section and an engagement section extending from the closure section at an acute angle.

7. The beverage container lid of claim 6, wherein the closure section includes a T-shaped protrusion extending perpendicularly from a bottom surface of the closure section.

8. The beverage container lid of claim 7, wherein the first sealing element is releasably coupled to the T-shaped protrusion of the closure section.

9. The beverage container lid of claim 6, wherein the closure structure includes an opening formed therein, the opening providing a nose void for clearance of a user's nose during drinking from the beverage container.

10. The beverage container lid of claim 1, wherein the selection structure includes grooves on opposing side surfaces for slidable engagement with the lateral extension guides of the lid body.

11. The beverage container lid of claim 1, wherein a first groove or detent of the lid body corresponds with a vent position of the latch structure resulting in a partially elevated position of the first sealing element relative to the first opening to permit venting and drinking from the first opening.

12. The beverage container lid of claim 1, wherein a second groove or detent of the lid body corresponds with a close position of the latch structure resulting in a normally sealed engagement of the first sealing relative to the first opening and permitting selective pivoting of the latch structure to elevate the first sealing element from the first opening.

13. The beverage container lid of claim 1, wherein a third groove or detent of the lid body corresponds with a lock position of the latch structure preventing pivoting of the latch structure and maintaining the first opening closed by the first sealing element.

14. The beverage container lid of claim 1, wherein a fourth groove or detent of the lid body corresponds with a clean position of the latch structure, the clean position permitting pivoting of the latch structure by at least 90° relative to a top surface of the lid body.

15. The beverage container lid of claim 1, comprising a button assembly including a button and a spring, the spring imparting a bias force against the selection structure at one end and imparting a bias force with the button against the latch structure at an opposing end.

16. A beverage container, comprising:

a vessel configured to receive a beverage, and a lid assembly detachably coupled to the vessel, the lid assembly including:

a lid body including a first opening formed therein;

a latch structure pivotably coupled relative to the lid body, the latch structure including (i) a first sealing element configured to align with the first opening and open or close the first opening in the lid body during pivoting of the latch structure relative to the lid body, and (ii) an engagement assembly configured to releasably engage with the lid body to allow for positioning of the latch structure in three or more operational mode positions; and a selection structure slidably engaged with lateral extension guides of the lid body;

wherein:

the selection structure includes at least one spring-loaded bearing biased laterally outward by a spring; and the lid body includes grooves or detents formed therein, each of the grooves or detents corresponding with a respective one of the three or more operational mode positions of the latch structure.

17. A method of operating a beverage container lid, the method comprising:

pivoting a latch structure relative to a lid body, the lid body including a first opening formed therein, and the latch structure including (i) a first sealing element configured to align with the first opening and open or close the first opening in the lid body during pivoting of the latch structure relative to the lid body, (ii) an engagement assembly, and (iii) a selection structure slidably engaged with lateral extension guides of the lid body; and releasably engaging the engagement assembly with the lid body to position and retain the latch structure in three or more operational mode positions;

wherein:

the selection structure includes at least one spring-loaded bearing biased laterally outward by a spring; and the lid body includes grooves or detents formed therein, each of the grooves or detents corresponding with a respective one of the three or more operational mode positions of the latch structure.

* * * * *